US006276354B1

(12) United States Patent
Dillon

(10) Patent No.: US 6,276,354 B1
(45) Date of Patent: Aug. 21, 2001

(54) GAS POWERED GUN AND ASSEMBLIES THEREFOR

(76) Inventor: Joseph Dillon, 3357 Mission Ave., Suite 1, Oceanside, CA (US) 92054

( * ) Notice: Subject to any disclaimer, the term of this patent is extended or adjusted under 35 U.S.C. 154(b) by 0 days.

(21) Appl. No.: 09/177,832

(22) Filed: Oct. 23, 1998

(51) Int. Cl.[7] ..... F41B 11/06; F41B 11/32

(52) U.S. Cl. ..... 124/74; 124/72; 124/31; 124/83

(58) Field of Search ..... 124/70, 71, 72, 124/73, 74, 75, 31, 83, 76, 56; D21/572, 570, 573

(56) References Cited

U.S. PATENT DOCUMENTS

| | | | | |
|---|---|---|---|---|
| D. 353,853 | * | 12/1994 | Albritton | D21/572 |
| 1,327,723 | * | 1/1920 | Midyett | 124/83 |
| 3,788,298 | * | 1/1974 | Hale | 124/76 |
| 3,855,988 | * | 12/1974 | Sweeton | 124/56 |
| 4,021,037 | * | 5/1977 | Torbet | 473/431 |
| 4,207,857 | * | 6/1980 | Balka, Jr. | 124/56 |
| 4,304,213 | * | 12/1981 | Jereckos | 124/69 |
| 4,616,622 | * | 10/1986 | Milliman | 124/73 |
| 5,228,427 | * | 7/1993 | Gardner, Jr. | 124/71 |
| 5,669,369 | * | 9/1997 | Scott | 124/73 |

* cited by examiner

*Primary Examiner*—Peter M. Poon
*Assistant Examiner*—James S. Bergin
(74) *Attorney, Agent, or Firm*—Donn K. Harms

(57) ABSTRACT

An improved air gun for firing paint balls, pellets,, consisting of a passively venting and freeze resistant regulator, a pressure differential trigger mechanism, and a muzzle break with angled sidewalls. The freeze resistant regulator regulates incoming high pressure gas to a user predetermined pressure to operate the gun while avoiding freezing of the regulator associated with frigid incoming compressed gases and high firing rates. This is accomplished by using a heat transmission component formed by the engagement between a hemispheric shaped tip of a regulating pin and a hemispheric cavity of an adjustment piston. Passive venting of gas from the gun upon removal of the pressurized gas supply is provided by the regulator using a reciprocating regulating pin and adjustment piston which combine to compress a seal into a seat only when pressurized gas is attached to the air gun. Once detached from a pressurized air supply the compressed air in the gun vents through the seat. Firing of the gun is achieved using a pressure differential trigger mechanism capable of fine pull adjustment using a trigger biasing mechanism. Greater accuracy of projectiles leaving the gun is provided by the muzzle break featuring of a plurality of elongated oval slots having angled sidewalls to parse propulsion gases from the projectile which reduces air turbulence encountered by the projectile upon exit from the gun.

19 Claims, 5 Drawing Sheets

GAS POWERED GUN AND ASSEMBLIES THEREFOR

BACKGROUND OF THE INVENTION

1. Field of Invention

The present invention relates to guns which propel lightweight projectiles using compressed gas as a propellent. More particularly, it relates to an improved paint ball or other gas powered projectile guns such as BB or pellet guns, and a gas pressure regulator, a trigger mechanism, and a muzzle break for utilization in combination therein.

2. Prior Art

Compressed air powered guns, such as paint ball guns, BB guns, and pellet guns, function to fire a projectile using compressed air as the source of power to accelerate the projectile down an axial chamber from the breech end of a gun barrel and out the muzzle or distal end of the barrel, toward the toward the target. Such air guns are conventionally powered by compressed air from a gun mounted hand activated pump for compressing air from the atmosphere into a storage chamber on the gun, or, by a canister of highly compressed gas of the user's choosing, attached to the gun, and communicating pressurized gas through a conduit system to convey a regulated gas supply for propelling the intended projectile.

The devices disclosed herein are directed at an improved gas powered gun which uses one or more of the different assemblies disclosed herein to improve both the accuracy of the projectile fired from the gun as well as the actual mechanical performance of the gun. By using one, or all of the different improvements herein disclosed, an improved air powered gun is achieved.

Prior art in the area of air powered guns, and especially paint ball guns, use canisters of liquid $CO_2$ or other compressed gas communicating high pressure gas supply to regulators to provide a regulated gas supply to the gun. Such guns using conventional regulators have a natural tendency to freeze due to the inherent frigid characteristics of liquid gases used in the canisters. Whether using $CO_2$ or similar gasses, which frost immediately upon pressure decrease, or just compressed air, the regulators on prior art tend to freeze when highly compressed air from a canister is regulated down to a useable pressure for the gun. Currently, liquid $CO_2$ and similar type gases are especially popular for such canister air supplies. Consequently gun performance can be severely inhibited when rapid fire of the gun causes repeated and increased cooling of the regulator which must lower the pressure supplied to fire the projectile when the trigger is activated.

Further, the regulators used currently, also tend to leave compressed air in the gun sufficient to power one more projectile down the barrel, even after the canister is removed from communication with the input side of the regulator. The result being a very dangerous situation wherein the gun appears to be safe with the air canister removed, while in fact, one more shot is possible if the trigger is pulled.

A second problem with current art in the field of air powered guns and more specifically paint ball guns, is the complexity of the trigger mechanisms. The complex systems of cams, rods, springs, and hooks, currently in use on air guns, leads to slow firing characteristics of the guns, and jamming of the plethora of parts contained in the trigger mechanism. Further, trigger pull pressures to activate the trigger of the gun tend to be excessively high, long, and not easily adjusted, causing finger and hand fatigue of the user as well as slow firing of the gun. However, in view of the natural tendency of regulators of air supply for such guns to freeze, this slow and excessively resistant trigger mechanism is frequently required to prevent conventional regulators from freezing up.

By using the regulated air supply from the low side of the regulator to return the trigger to firing position, and a simple air differential firing mechanism activated by a trigger pull, all such complicated parts to the mechanism are eliminated. Further, trigger squeeze adjustment is simply achieved by using a biasing means such as a spring and adjustment screw to help overcome the force of the regulated air holding the trigger forward in firing position.

Finally, conventional muzzle breaks used on air guns and especially paint ball guns, are formed using drilled holes or slots in the gun barrel in a direction perpendicular to the barrel. Such conventional venting allows for some of the compressed gas to the rear of the paint ball or other projectile to vent at the distal end of the barrel thereby allowing the projectile to exit the barrel with less disturbance of the air around it. The result being a lessening of gas pressure caused disturbance at the rear of the projectile and the lessening of the accuracy of the projectile to do air disturbance around it on an exit from the barrel.

With the high firing rate achieved by the improved freeze resistant regulator and the improved trigger mechanism allowing for faster firing, an improved muzzle break at the distal end of the barrel can provide even greater accuracy of the gun. By placing elongated oval slots in the distal end of the barrel parallel to the center axis of the gun barrel, and angling the sidewalls of the slots at an angle between 30 to 50 degrees, an active parsing of the gasses, rear of the projectile is achieved, rather than just an exit orifice for such gasses, as in convectional muzzle brakes.

U.S. Pat. No. 5,669,369 (Scott) teaches an improved regulator that exhausts the air propellent from the gun when the supply canister is removed. However Scott fails to address the tendency of such a device to freeze when a high fire rate is achieved and could possibly freeze and fail to release the last regulated air charge from the gun as well as causing a cease in operation while the canister is connected.

U.S. Pat. No. 3,788,298 (Hale) provides a trigger pull adjustment, however, Hale uses a complex system of springs and levers to activate the trigger and is prone to freeze up as well as mechanical disfunction during operation.

U.S. Pat. No. 5,228,427 (Gardner) addresses the issue of a muzzle break by using a plurality of holes in the barrel. However, the holes exit gasses using gas pressure inside the barrel rather than having sidewalls angled to help parse gasses from the barrel behind the projectile.

As such, there exists a need for an easily and inexpensively manufactured air powered gun, which provides for a regulated air supply to fire the gun which will not cause a freeze up of the regulator providing that supply. A further need exists for a simple trigger mechanism, which will alleviate jamming caused by mechanically complex triggers, and, provide for easy trigger travel and pull adjustment to user preferences. A further need exists for an improved muzzle break design which will actively parse gasses from the barrel, using angled sidewalls to achieve such, thus decreasing air turbulence imparted to the projectile on an exit from the barrel.

SUMMARY OF THE INVENTION

Applicant's device provides an easily manufactured and operated air gun apparatus which will operate more efficiently than current devices. It features an improved regulator to provide a regulated air supply to power the gun while concurrently avoiding freezing of the regulator caused by the pressure differential between the highly compressed gas in the canister being lowered to the operating pressure of the gun. The design of the regulator, in addition to preventing freezing, also allows for the venting of the regulated gas from the interior of the gun when the supply canister is removed from the channel communicating with the input of the regulator. This venting achieves a huge increase in safety due to the evacuation of the supply of compressed gas available to the projectile, thus avoiding accidental firing after the canister is removed by user's who might pull the trigger accidentally or intentionally, believing the gun is no longer loaded. The regulator can be used separately, together, or in other devices where a constant stream of pressurized gas is required.

Additional improvement is achieved by a trigger mechanism. The trigger mechanism operates to fire the gun using a pressure differential firing means instead of the complicated mechanical mechanisms employing cams and springs which currently operate in such guns. The trigger, connected to a trigger rod and communicating trigger pin, is also returned to firing position by the regulated air supply communicated from the regulator which forces the pin forward at the regulated pressure to a defined stopping point. A pull of the trigger forces the communicating trigger pin rearward where a slot in the trigger pin communicates a pressure differential between air chambers in the gun causing the gun to fire. The trigger mechanism, by using pressure differential to fire the gun, eliminates the need for cams and return springs to activate the gun. This elimination of parts achieves a virtually jam proof trigger mechanism which is concurrently easily adjusted force adjustment for desired trigger pull to fire the gun, by an adjustment screw and biasing spring or other means of biasing the trigger toward the firing position. Of course, this improved trigger mechanism, by itself, or in conjunction with other elements of the device herein disclosed, could be used in other types of conventionally sold and used air guns which use regulated air pressure for propellent in addition to its combination herein to improve their performance.

Further improvement is achieved in the accuracy and operation of the gun by muzzle break communicating through the gun barrel which features a plurality of elongated slots having angled sidewalls. These elongated slots are cut into the distal end of the gun barrel parallel to the elongation of the gun barrel. As the projectile passes though the gun barrel in the area of the elongated slots, evacuation of air pressure from the vicinity of projectile occurs through the elongated helical slots and is aided by the angled sidewalls of the slots which help parse the escaping gas from the interior of the gun barrel and away from the front and rear of the accelerating projectile. This allows the projectile to move from the gun in a straighter fashion by eliminating air disturbance on exit from the barrel as well as minimizing spin of the projectile.

An object of this invention is providing a regulator for use in combination with an air gun such as a paint ball gun or pellet gun, which will not freeze during use with cold propellents gas specially during high rates of firing of the gun.

Another object of this invention is to provide additional safety to the user and bystanders by the provision of a regulator which vents pressurized air propellent in the gun when the supply canister or other air supply is removed, thereby rendering the gun unusable.

A further object of this invention is to provide a trigger mechanism for an air gun that is reduced in mechanical complexity and is thereby jam resistant.

An Additional object of the invention is to provide a trigger mechanism that is easily adjustable for pull as well as capable of a high rate of fire with minimum effort by the user.

A further object of this invention is to provide an improved muzzle break for evacuation of gasses from the gun barrel thereby increasing projectile accuracy by diminishing air turbulence at the exit end of the gun barrel.

Further objects of the invention will be brought out in the following part of the specification, wherein detailed description is for the purpose of fully disclosing the invention without placing limitations thereon.

BRIEF DESCRIPTION OF DRAWING FIGURES

DETAILED DESCRIPTION OF THE PREFERRED

EMBODIMENTS OF THE INVENTION

Figure 1:
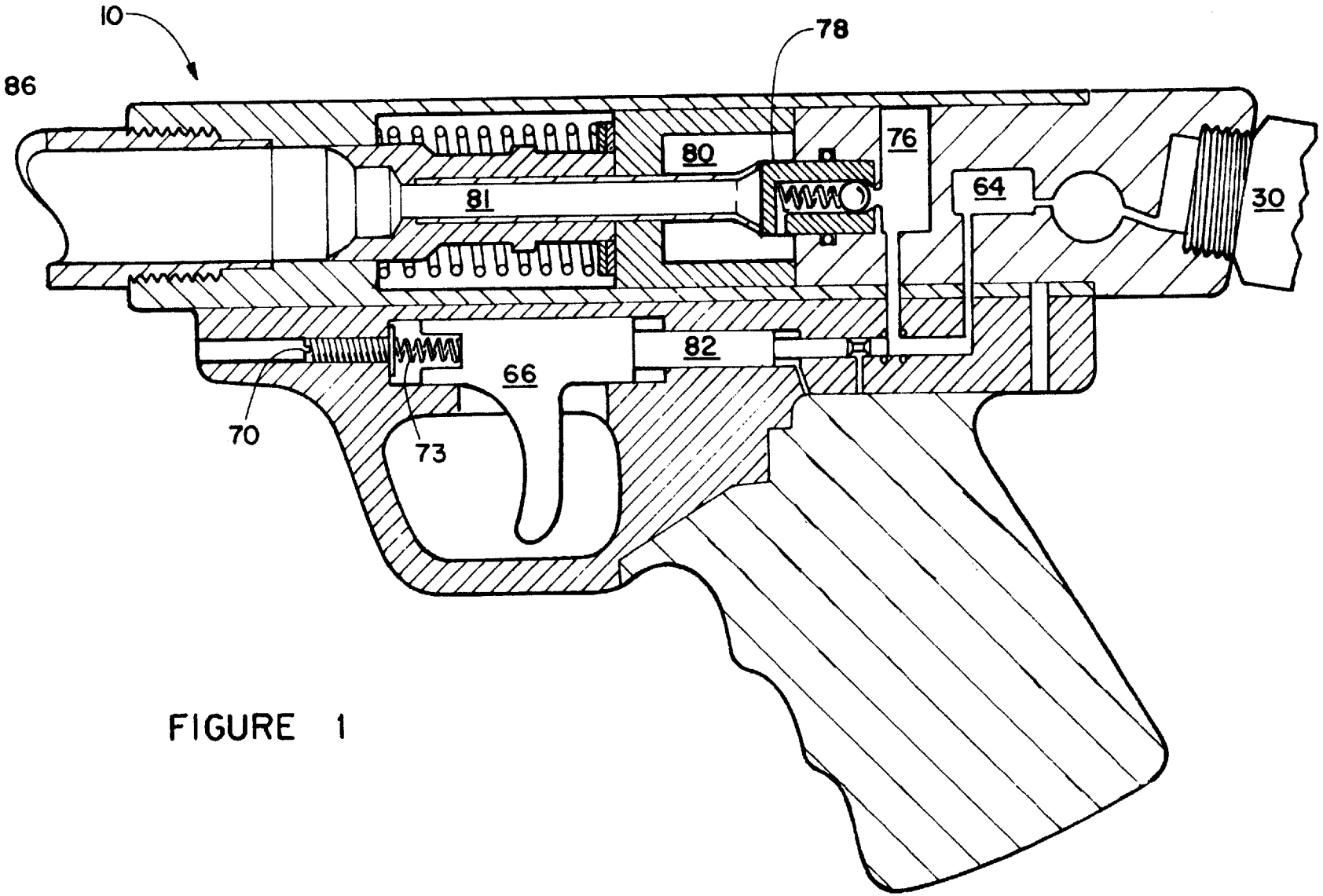
FIG. 1 is a cut away side view of an air gun embodiment of this invention.

Referring now to the drawing figures which depict the preferred embodiments of the invention disclosed herein, specifically FIG. 1 is a cut away side view of an improved air gun 10 showing having a regulator means shown by the improved regulator 30 which receives highly pressurized gas from a conventional gas supply such as a pressurized canister 12 and reduces the pressure of pressurized gas received from the canister to a gas pressure desired or required to operate the gun 10.

Also shown is the air biased trigger mechanism 62 which is biased by regulated gas communicated from the regulator 30 and an adjustable rearward biasing mechanism such as a trigger spring 73 adjustable for rearward bias by trigger spring adjustment screw 79. Additional pictured is the muzzle break 70 featuring a plurality of elongated slots 72 having angled side walls 74 for better parsing of gas propellent away from any projectile being fired.

Figure 2:
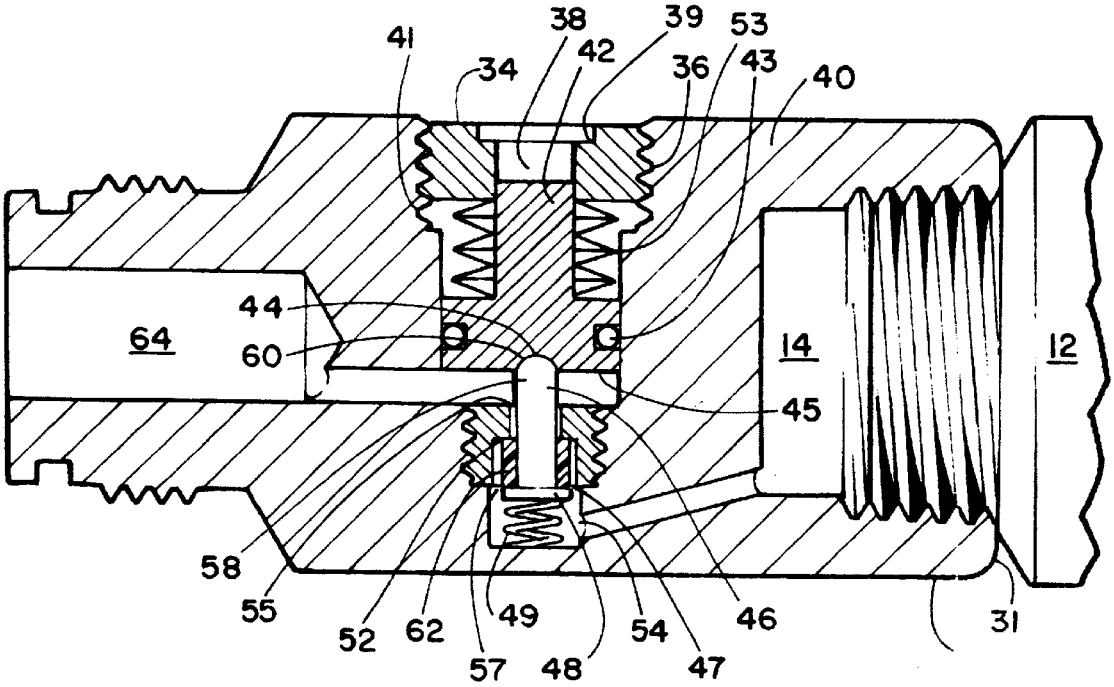
FIG. 2 is a cut away side view of the regulator for use in combination with an air gun in operation in a pressurized state.
Figure 3:
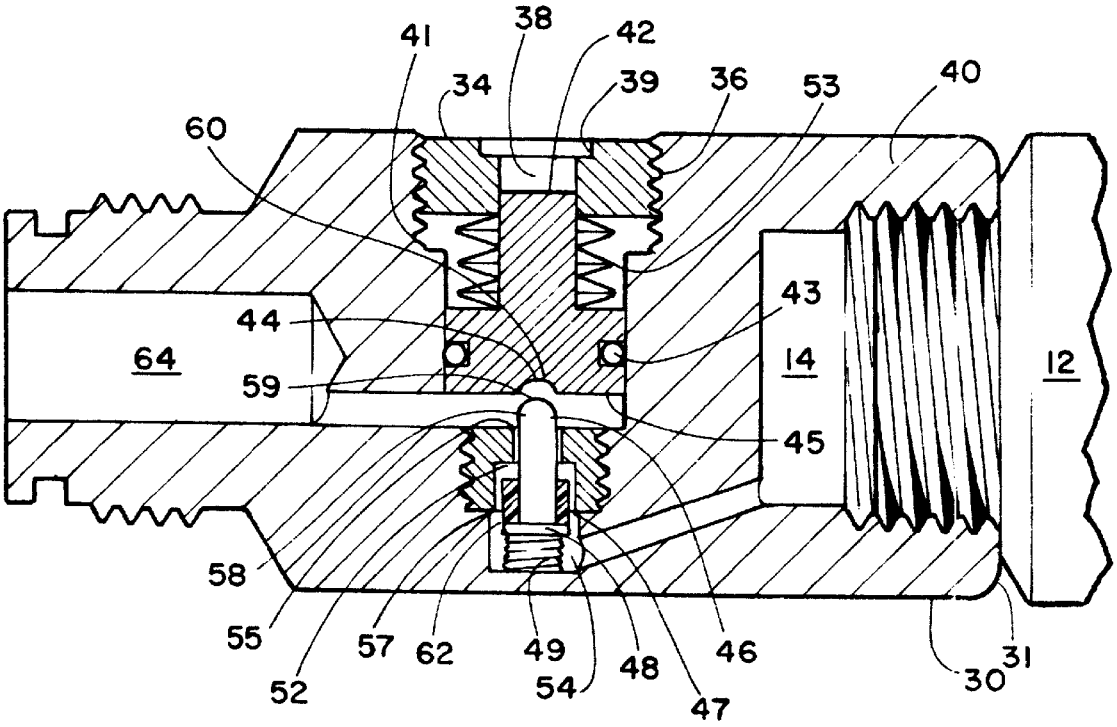
FIG. 3 is a cut away side view of the regulator for use in combination with an air gun showing an un pressurized state.

FIGS. 2 and 3 are a cut away side views of the regulator 30 in a pressurized condition 31 and the regulator in an un-pressurized or venting condition 32 with the conventional air supply canister 12 dis-attached wherein pressurized air being maintained in the gun is vented to the atmosphere back through the input cavity 14. The regulator 30 as herein disclosed can be used in combination with the air gun 10 disclosed herein or in combination other air powered guns requiring regulated gas pressure which would benefit from the self venting safety characteristics and anti freezing characteristics provided by the disclosed regulator 30 design.

The regulator 30 by design is compact, and easily adjustable means for output pressure adjustment using the adjustment screw 34 which has threads 36 about its circumference, and which is accessible through a regulator adjustment aperture 38 in the body portion defined by the casing 38 of the regulator 30. The body portion could also be made part of or formed into the gun itself should permanent mounting of the regulator 30 should casting of the gun body and regulator in one piece be desirable however the current best mode features the removable mounting of the regulator 30 to the gun. The adjustment aperture 38 has wall threads 41 which cooperatively engage the screw threads 36 and also provides access to the adjustment screw 34 from the exterior of the casing 38. Outlet pressure of the regulator 30 is adjusted using a conventional hex wrench or screw driver or similar tool which engages a receiving slot 39 which is formed in the adjustment screw 34 to cooperatively engage the conventional hex wrench or other tool. By turning the tool in the receiving slot 39 the adjustment screw 34 will turn and the threads 36 will cooperatively engage wall threads 41 in the casing 40 and move toward or away from a valve pin 46. Moving the adjustment screw 34 toward the valve pin 46 causes the screw 34 to compress piston spring 53 which in turn increases the bias of the piston spring 53 against the adjustment piston 42 in the direction of valve pin 46 which is operatively fit into a seat aperture 55 of seat 52 such that it will operatively laterally translate therein. The more pressure or bias provided by the piston spring 53 against the adjustment piston 42, the higher output pressure of the gas supplied to the input conduit 72 of the gun 10. This is because more pressure from the incoming gas will be required to bias the engagement end 58 of the valve pin 46 into the adjustment piston 42 to overcome the bias of the piston spring 53 thus translating the adjustment piston 42 toward the adjustment screw 34 to stop the flow of pressurized gas through the seat aperture 55. This pressure by incoming pressurized gas on the head portion 48 causes it to press against seal 62 which in turn is forced into a sealing position in the seat 52 which is mounted in a central aperture 57 to stop the incoming flow of regulated pressurized gas communicated from the canister or other pressurized gas supply means past the seal 62 compressed in the seat 52 thus stopping the flow through the seat aperture 55. A piston seal 43 positioned on the adjustment piston 42 prevents leakage of pressurized gas past seat the adjustment piston 42, between the adjustment piston 42 and the adjustment aperture 38 mounted in a central conduit providing communication between the input cavity 14 and the exit chamber 64 in a conventional sealing fashion.

The valve pin 46 and seal 62 mounted thereon are sized to reciprocate operatively inside a seat aperture 47 of seat 52 which is cooperatively engaged and removably mounted inside of a gas entry cavity 54 using cooperatively engaged threads 56 about the seat 52 and entry cavity 54. Other conventional methods of mounting the seat 52 such as a press fit or a bayonet mount might also be used but the cooperating threads are the current best embodiments.

The valve pin 46 features a head portion 48 and an engagement end 58. The engagement end 58 of the valve pin 46, in the current best embodiment, features hemispheric or half circle shape tip 59 surface and is distal to the head portion 48. The engagement end 58 hemispheric tip 59 is dimensioned to cooperatively engage a hemispheric cavity 44 on the face of adjustment piston 42 when in the regulating mode 31 with a canister 12 or other high pressure gas supply attached. This engagement of the hemispheric tip 59 and hemispheric cavity 44 during biased contact provided by the gas pressure on the valve pin 46. Engagement is also constant during times when the hemispheric tip 59 and hemispheric cavity 44 when the force of the spring bias and incoming pressure bias are substantially equal, yielding a much larger surface area of cooperative engagement between the two than would be possible with conventional flat surfaces of engagement in conventional regulators. This substantial enlargement of contact area provides a substantially increased ability for heat transmission from the piston 42 to the valve pin 46. While other shapes might be used to cooperatively engage the two parts and yield a larger surface area of engagement, such shapes being anticipated, the hemispheric shape is the current best embodiment yielding the highest area of surface contact between the piston 42 and valve pin 46 to prevent freezing of the regulator 30 even during rapid fire of a gun using extremely cold liquid $CO_2$.

The result of this large surface area of cooperative engagement between the tip 59 and cavity 44 effectively yields a heat transmission means yielding the heat sink 60 to transmit heat from the atmosphere through the exterior of the casing, to the valve pin 46 and the and head portion 48 by the large surface area of engagement of the cooperative engagement of the hemispheric tip 59 of the valve pin 46 and the hemispheric cavity 44. Or, conversely, cold temperatures from incoming compressed or conventionally used liquid $CO_2$ gas, which generally will freeze conventional regulators during rapid firing of the gun, are sufficiently raised, by transmission of heat from the casing 40 and atmosphere, through the adjustment piston 42 and the large cooperating surface areas provided by the hemispheric cavity 44 thereon and to the valve pin 46, when the hemispheric tip 58 cooperatively engages the hemispheric cavity 44 on the adjustment piston 42. It is the greatly increased surface area of cooperative engagement of the rounded or hemispheric tip 59 and cooperatively shaped cavity 44, which form the heat sink or means for transmitting heat 60 component of the regulator 30. Of course, such a means for transmitting heat 60 could be added to conventionally used regulators for guns using compressed air to improve their performance and it is anticipated that such an inclusion can be made to improve such conventional regulators.

Additional resistance to freeze up of the regulator is provided by the oversized seal 62 which in the current best mode is elongated and cylindrical in shape. Conventional seals of rubber are generally flat or very short style conventional 0 rings and will generally harden and fail due to hardness from freezing of the seal caused by incoming gas temperatures. This hardening not only leads to failure of conventional seals, it also leads to cracking of the seal and failed regulators as well as freeze up of conventional regulators during rapid fire of the gun.

The disclosed seal 62 is removably mounted about the valve pin 46, adjacent to the head portion 48, by slidably locating the seal 62 on the valve pin 46 through the passage in the center of the seal 62 sized to accommodate the circumference of the valve pin 46 to achieve a snug fit of the seal 62 on the valve pin 46 and in the seat aperture 55 when in a sealing position. The head portion 48 of the valve pin 46 acts as a stop to maintain the seal 62 upon the valve pin 46 when operatively positioned for reciprocating movement in the seat aperture 55 of seat 52. By constructing the cylindrical seal 62 in an elongated or oversized fashion having an axial length at least one-third the length of the valve pin 46, instead of conventional flat or "o" ring construction, the seal 62 is better able to resist the freezing temperatures encountered with high pressure gases or liquid $CO_2$ incoming from the canister 12. Further, by forming the seal 62 of a high resilience semi-hard copolymer of substantially a 95 shore, the seal exhibits even greater resistance to failure caused by freezing and cracking from frigid incoming gases, and the compression of the seal 62 between the head portion 48 and the seat 52 when the seal is 62 is operating to stop the flow of the gas.

In regulating operation, the regulator 30 regulates the high pressure of incoming gas from pressures up to 3500 psi from the gas supply or pressurized canister 12 by cutting off the supply of pressurized gas communicated to the gun when the desired pressure is reached in the gun and communicating exit chamber 64. This pressure regulation is achieved by the interaction of the incoming pressure of the pressurized gas upon the head portion 48 of the valve pin 46 communicating force sufficient to translate the valve pin 46 toward the engagement end 58 biasing the hemispheric tip 59 into the hemispheric cavity 44 of the adjustment piston 42. The seal 62 is maintained out of a sealing mode wherein it would be sufficiently compressed between the seat 52 and the head portion 48 by the bias provided by the pressure spring 37 to the adjustment piston 42 and resulting in a determined biased contact between the cooperatively engaged hemispheric cavity 44 and hemispheric tip 59 of the engagement end 58. The determined biased contact of cavity 44 and tip 59 in the direction of the head portion 48 allows gas flow past the seal 62 and through the seat aperture 55 between the outside circumference of the seal 62 and the aperture 55 operatively positioned in a seat aperture 47 formed in the seat 52 and thereafter, out of the regulator through the exit chamber 64 to the communicating gun. This reciprocating biased positioning of the engagement end 58 by incoming gas pressure and the cavity 43 by the spring 53 or other biasing means, and the ability to adjust the lateral position the piston 42 by adjustment of bias thereon, in relation to its engagement end 58, yields an infinite number of positions of a determined biased engagement of the two between their points of translation. This yields an infinite number of output pressure adjustments of the regulator 30 between the input pressure and desired output pressure.

Optionally, a bleed spring 49 may be provided to prevent accidental discharge of the gun when the canister 12 or other pressurized gas supply is removed very quickly. This bleed spring provides sufficient bias of the valve pin 46 toward the cavity 44 to allow a slow release of pressurized gases from the accumulation chamber 80 and connecting chamber 76 back through the input cavity 14 when the canister 12 is removed. This prevents accidental firing of the gun caused by a very rapid drop in pressure between the accumulation chamber 80 and the connecting chamber 76. However on guns which use conventional mechanical trigger mechanisms instead of the pressure differential trigger mechanism disclosed herein, the bleed spring 49 would not be necessary. Alternatively, some form of slow bleed mechanism, which would bleed tank pressure over a few seconds, and then allow the tank to be removed, could be installed.

In use, compressed and regulated gas will flow to the gun until such time as a user predetermined level of gas pressure builds in the exit chamber 64, which then communicates that pressure level with a face 45 on the adjustment piston 42 and moves the adjustment piston 42 away from and substantially out of piston spring 53 biased contact with the hemispheric tip 59 of the valve pin 46 since the air pressure overcomes the bias of the piston spring 53. When moved away from the piston spring biased contact with the hemispheric tip 59 of the valve pin 46, gas flow is cut off past the seal 62 when the head portion 46 compresses the seal 62 into the seat 52 stopping the flow of gas past the seal 62 through the seat aperture 55 to the exit chamber 64.

This predetermined pressure level to cut off gas flow is determined by adjustment of the aforementioned adjustment screw 34 to thereby place additional bias upon the piston spring 53 to in turn adjust the spring bias to the adjustment piston 42 to an infinite degree between the respective points of lateral translation of the piston 42 and the compression provided by the screw 34. With more bias translated to the adjustment piston 42 toward the engagement end 58 of the valve pin 46, more gas pressure on the valve pin 46 is required to move the adjustment piston 42 to a position out of piston spring biased contact between the hemispheric tip 58 of the valve pin 46 and the hemispheric cavity 44 on the face 45 of the adjustment piston 42. Thus, the greater the pressure of the gas that will build in the exit chamber 64 which will therein be communicated to the gun 10 to propel a projectile therefrom.

Once the predetermined pressure is achieved, the adjustment piston 42 moves substantially out piston spring biased contact with the valve pin 46 causing the seal 62 to come to rest between the head portion 48 of the valve pin 46 on one end, and the seat 52 on the other end of the seal 62, thereby cutting off the higher pressure gas communicating from the canister 12 and through the axial seat aperture 47 past the seal 62 to the exit chamber 64. The valve pin 46 thus reciprocates in the appropriately dimensioned axial seat aperture 47 of seat 52 between a sealed position substantially out of sufficiently biased contact with the piston 42, and a venting position, depending upon the bias of the pressure spring 37 and the pressure, or lack thereof, of incoming gas on the head portion 48 of the valve pin 46.

As shown in FIG. 3, where the regulator 30 is in a venting position 32, with air supply removed, the reciprocating action of the pin 46 inside the appropriately dimensioned seat aperture 47 of the seat 52 yields an additional and very important safety characteristic of the regulator 30. This is because once the gas supply or gas canister 12 is removed, higher air pressure in the exit chamber 64 than in the input cavity 14 will be communicated to the valve pin 46, causing it to immediately move away from air pressure biased contact with the adjustment piston 42 and cause the seal 62 to unseat from operative contact with the seat 52. This action vents any stored charge in the accumulation and connecting chambers of the gun 10 back through the communicating exit chamber 64 of the regulator 30, past the seal 62, through the axial seat aperture 47, and out to the atmosphere through the input cavity 14 of the regulator 30, rendering the gun unable to fire.

On the gun herein disclosed which uses the pressure differential trigger mechanism, and optional bleed spring 49 is provided and attached to head portion 48 to slightly bias the valve pin 46 toward the piston 42 when incoming air pressure is removed or substantially reduced, thereby providing a sufficient delay in the evacuation of pressurized gas from the accumulation chamber 80 and connecting chamber 76 to avoid firing due to an immediate or instantaneous pressure drop which might cause a firing of the differential trigger mechanism. As noted, this regulator can also be used on air guns using conventional mechanical firing mechanisms and when so used the bleed spring 49 would be optional since firing of the gun is not accomplished using a pressure differential means in the trigger on such guns.

This passive venting of gas from the regulator 30 on release of the supply, is an improvement upon conventional regulators used for pressurized air guns. Conventional air guns, using conventional pressure regulators, continue to maintain one charge of compressed gas inside the gun, even after the regulator is removed. This creates a severe safety problem in that gun owners can easily assume that the gun will not fire with the air supply removed, when in fact, with conventional gun and regulator combinations, currently in use, the gun will fire one more time. Some affirmative action by the user is required on conventional air guns to vent the last charge held in the gun by conventional regulators which do not provide for the passive release provided by the disclosed regulator 30.

Figure 4:
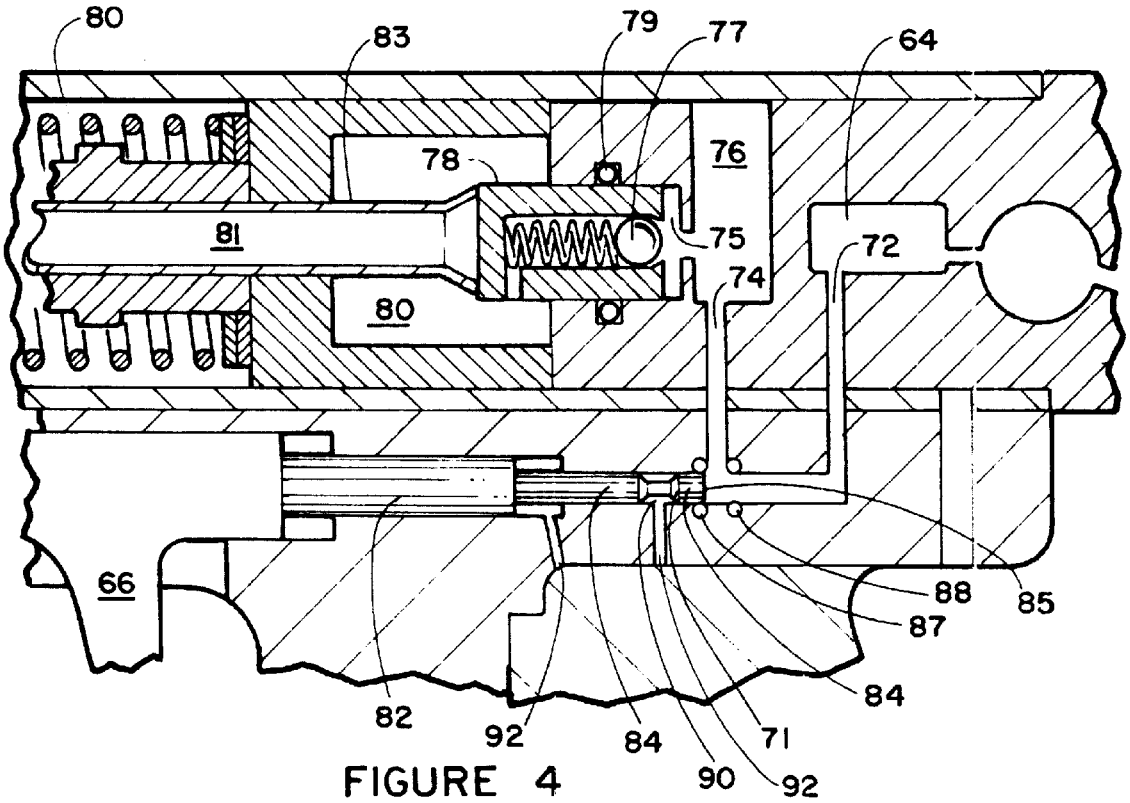
FIG. 4 is a side view of the air biased trigger mechanism for use in combination with an air gun.

FIG. 4 is a side view of the air biased trigger mechanism 70 for use in combination with an air gun, in a ready-to-fire, or cocked position 71. In the cocked position 71 incoming regulated pressurized gas or liquid gas is communicated from the exit chamber 64 of the regulator 30 to an input conduit 72 of the gun designed to receive the gas. The input conduit 72 communicates the pressurized gas to a second, or firing conduit 74 which in turn communicates the gas to a connecting chamber 76 on the gun for storing compressed gas. In addition to storing a first gas charge, the connecting chamber 76 communicates the regulated and pressurized gas through a one way valve chamber 77 operatively positioned in a laterally translatable check valve 78 which is positioned operatively in a passage 75 communicating between the connecting chamber 76 and an accumulation chamber 80. Pressure from the connecting chamber 76 on the check valve 78, biases the check valve 78 into a sealing position on the end of the axial passage 81, wherein pressurized gas is prevented from communicating from the accumulation chamber 80, to the axial passage 84 and to the breech end of the barrel 86. The bias of the check valve 78 against the input of the axial passage 81 is caused by the higher initial pressure of connecting chamber 76 pushing against the check valve 78 before the one way valve 77 opens in response to gas pressure communicated from the connecting chamber 76. Gas pressure then communicates through the one way valve 77 to pressurize the accumulation chamber 80 communicating with the other end of the one way valve 77. Concurrently, gas communicated through the check valve 78 charges the communicating accumulation chamber 80 of the gun through a one way valve 77 in the check valve 78 allowing gas to flow freely to the accumulation chamber 80 from the connecting chamber 76 but inhibiting or substantially restricting the free flow of gas from the accumulation chamber 80 back to the connecting chamber 76. A slow release of gas back to the connecting chamber 76 from the accumulation chamber 80 is allowed by the one way valve 77 when gas pressure in the connecting chamber 76 is slowly lowered over a period of a few seconds. However, if gas pressure in the connecting chamber 76 drops quickly due to a pull of the trigger by the user, then pressure in the accumulation chamber 80 is vented to the axial passage 81 because the check valve 78 will bias toward the connecting chamber 76.

During use the accumulation chamber 80 will continue to charge with pressurized gas through the check valve 78 until it reaches the predetermined pressure charge allowed by the aforementioned user defined pressure setting of the regulator 30. Once the predetermined pressure is reached, the gas flow from the communicating regulator ceases due to regulator 12 shutting off flow communicating into the connecting chamber 76 and also though the check valve 78 to the accumulation chamber 80 since pressure in the accumulation chamber 80 and communicating accumulation chamber 76 is then substantially equal.

Pressurized gas is also concurrently communicated to the rear face 85 of laterally translatable trigger pin 84, thus forcing trigger pin 84 to translate toward the trigger to return it to firing position. A trigger pin seal 87, such as a conventional "o" ring, encircles the outside of trigger pin 84 in a conventional fashion and prevents passage of pressurized gas past the trigger pin 84. The gun at this point is charged and ready to fire.

Figure 5:
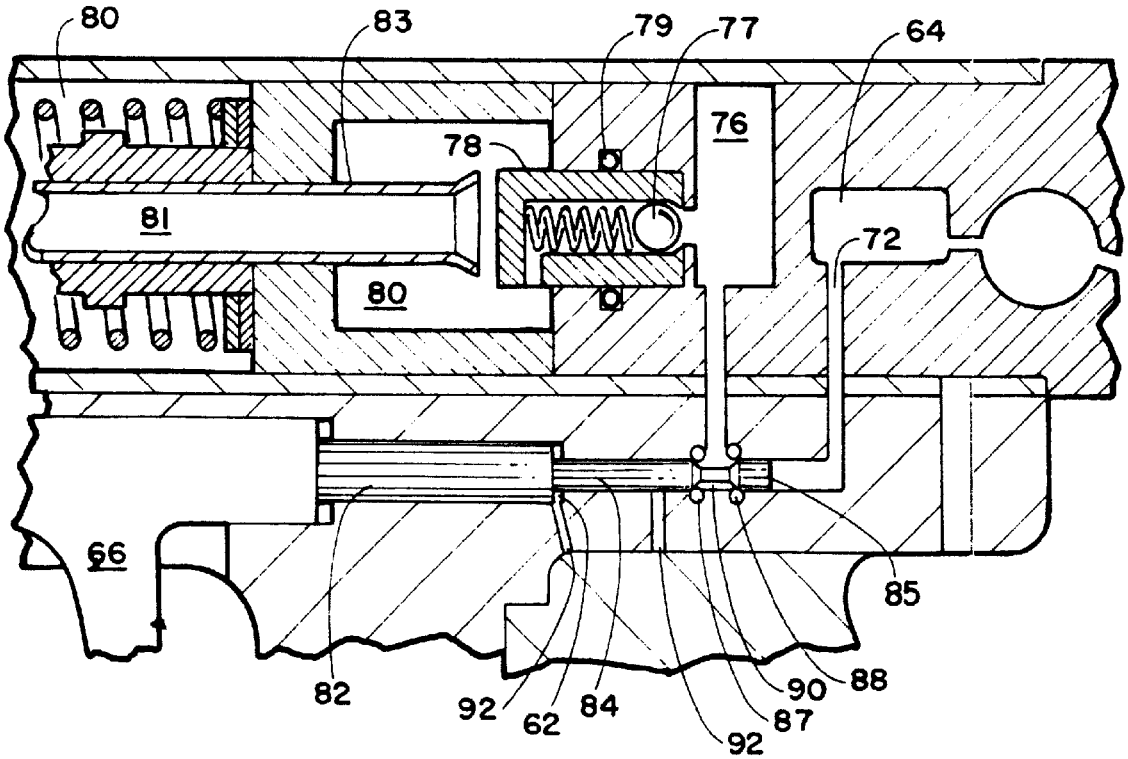
FIG. 5 is an additional side view of the trigger mechanism for use in combination with an air gun.

Firing the gun is shown in FIG. 5 is a side view of the trigger mechanism 70 in firing position. This is the point where the user has pulled the conventional trigger 66 on the gun. When the trigger 66 is pulled, a communicating laterally translatable trigger rod 82 is moved rearward, or, in the direction the trigger 66 moves when pulled. The trigger rod 82 therein, communicates lateral translation to the connected trigger pin 84 moving it from a first position wherein the gun is cocked for fire as shown in FIG. 4, to a firing position as shown in FIG. 5. In the cocked position as shown in FIG. 4, the trigger pin 84 is laterally translated toward the trigger to the firing position by biasing of incoming gas on the rear face 85 of the trigger pin 84 forcing the trigger pin 84 forward to allow communication of pressurized gas from the firing conduit 74 to charge communicating chambers 76 and 80 through check valve 78.

When moved to the firing position, by user compression of the communicating trigger 66, the rear face 85 of the trigger pin 84 is laterally translated past a firing seal 88. This firing seal 88 prevents incoming pressurized gas from passing to the firing conduit 74 by sealing around the outside of trigger pin 84. Concurrently, a notch 90 in trigger pin 84 is laterally translated past trigger pin seal 87 and allows communication between the firing conduit 74 and a vent 92 or vents, to the atmosphere.

During firing, pressurized gas stored in the connecting chamber 76 is instantly communicated through the vent 92 to the atmosphere creating a pressure differential between the accumulation chamber 80 and the connecting chamber 76 sue to the check valve 78 blocking communication between the two. Higher gas pressure on the laterally translatable check valve 78 from the accumulation chamber 80 causes it to translate in the direction of the lower pressured connecting chamber 76, unsealing a communication between the accumulation chamber 80 and an axial passage 81 at the breech end of the gun barrel and which communicates axially through the gun barrel from the breech end to the muzzle or distal end of the gun barrel. Of course this axial chamber 81 could also communicate gas with a gun barrel through a tube system or other conduit. Since the back flow of pressurized gas to the connecting chamber is restricted by the one way valve 77 of the check valve 78, the pressurized gas in the accumulation chamber 80, flows into to the communicating axial passage 81 which communicates pressurized gas to a projectile 91 to propel the projectile through the axial passage 81 of the barrel 86 to exit the barrel at a distal end of the barrel 86.

Release of the trigger 66 by the user causes the trigger rod 82 to laterally translate to the firing position due to pressure on the face 85 from incoming pressurized gas communicated thereto from the input conduit 72 and communicating regulator 30. This starts the process over again charging the connecting and accumulation chambers 76 and 80 to a ready state for firing of the gun in the aforementioned fashion.

If the pressurized gas supply, such as the canister 12, is removed from the regulator 30 in a normal fashion which involves unscrewing the canister 12 from the regulator 30 in a slow fashion, gas in the accumulation chamber 80 which is inhibited by the check valve 78 from back flow to the connecting chamber 76, will vent slowly to the connecting chamber and then to the atmosphere back through the regulator. This unsealing action of the translatable valve pin 46, due to lack of pressure on the head portion 48 caused the valve pin to become incapable of biased contact with the adjustment piston 43, thus allowing a venting of pressurized gases from the chambers 76 and 78 past the unseated seal 62 to the atmosphere through the input cavity 14. This renders the gun harmless and unable to fire due to the regulator 30 being able to vent pressurized gas from communicating conduits and chambers in the gun, back through the regulator.

A trigger adjustment is also provided in the preferred embodiment disclosed herein. Adjustment of the trigger pressure required by the user's finger can achieve a "hair" trigger, or if desired, a hard to use trigger, by adjusting of an adjustment screw 76 which adjusts the bias of a communicating biasing means such as a trigger spring 73 which imparts biasing pressure to the trigger rod 82 toward the firing position and helps overcome the forward lateral translation of the trigger pin 84 caused by the pressure of regulated compressed gas on the rear face 85 of the communicating trigger pin 84. By turning the adjustment screw 79 to cause compression of spring 73 more bias in the spring reduces the effort required of the finger to pull the trigger to overcome the forward bias of gas upon the face 85 of trigger pin 84 can be adjusted with great precision from a large, to a very small, amount of pressure required of the user to pull the trigger.

As can be seen, the best embodiment of the air gun 10 herein disclosed features this trigger mechanism and trigger adjustment, however, the trigger mechanism herein disclosed, could also be used by itself on most conventional air guns, to improve performance and utility of conventional air guns using mechanical trigger mechanisms.

Figure 6:
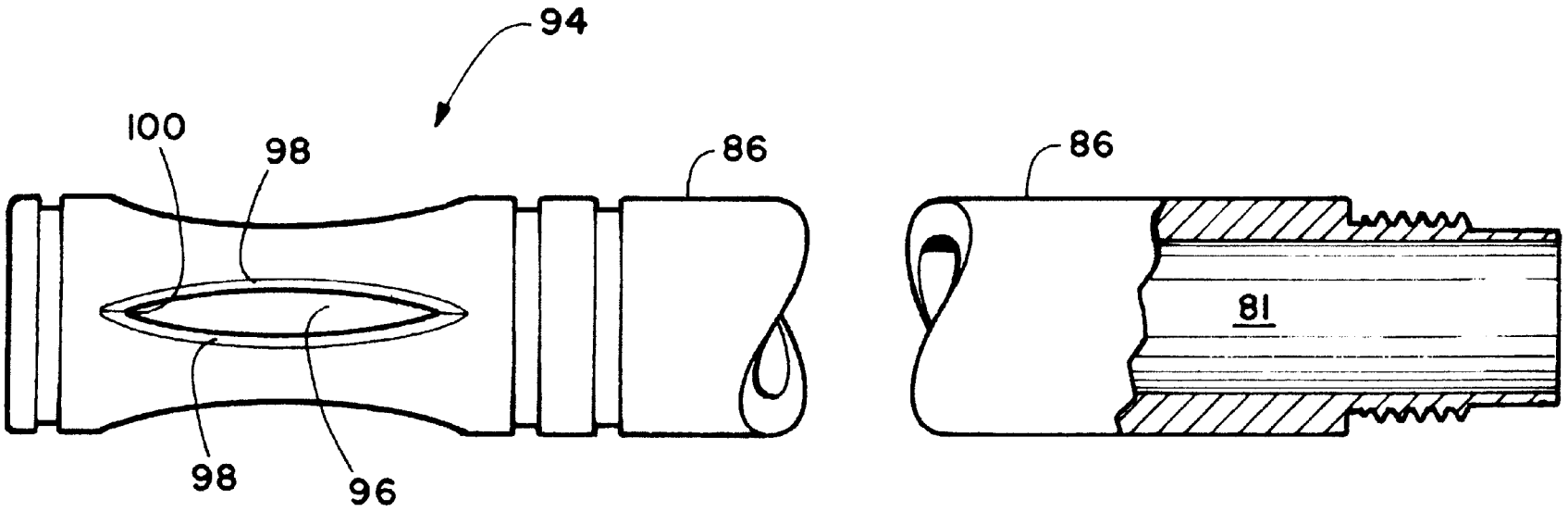
FIG. 6 is a side view of the exterior of the elongated muzzle break.

FIG. 6 is a side view of the exterior of the elongated muzzle break 94 placed in the distal end of the gun barrel 86. The muzzle break 94 communicates gases from the axial passage 81 defined by the wall portion 83 of the barrel 86 to the atmosphere, as the projectile passes through the area of the axial passage 81 to the muzzle end of the barrel where the muzzle break 94 communicates with the axial passage 81 and reduces the reversionary and projectile disturbing air currents upon the projectile as it exits the gun. The current best mode of the disclosed device features angled sidewalls 98 and an oval or helical shape, of a plurality of elongated slots 96. The plurality of elongated slots may also feature parallel sides, so long as the angled sidewalls 98 are included but the oval shape yields to best results.

This oval shape of the plurality of elongated slots 96 of the muzzle break 94 combined with the angled sidewalls 98 helps cut or parses the gas from in front of and behind the projectile being fired from the gun due to the easier flow of gases up the inclined angles formed. The angle of the sidewalls starting at the axial chamber 84 and angling outward toward the outside surface of the barrel 86 works best between 30° C. and 50° C. depending on barrel length and the bore defining the axial chamber 84. Further, the increased diameter of the oval shaped elongated slots 96 provides the same area for exiting gases as a slightly shorter straight or parallel shaped slot, while allowing for the angled sidewalls 98 and knife like point 100 to further aid in parsing of gasses. The angled sidewalls 98 when combined with oval elongated slots 96 thus perform better than conventional muzzle breaks that do not feature the angled sidewalls 98 and oval shape by providing an easier escape route to the atmosphere than conventional sidewalls having sidewalls that are perpendicular to the barrel surface.

Figure 7:
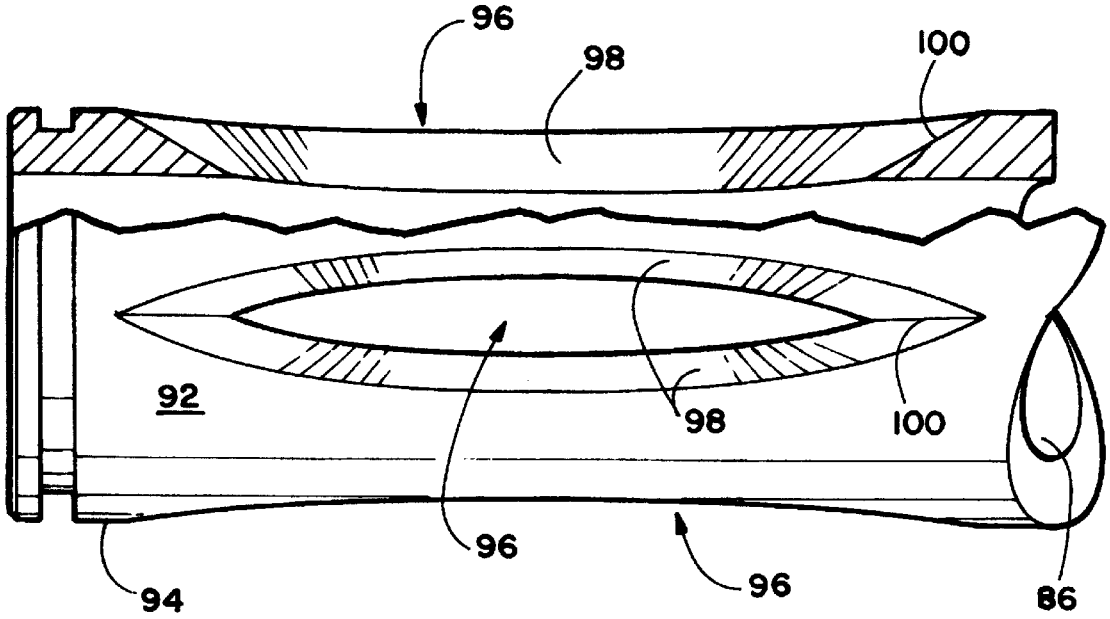
FIG. 7 is a view of the muzzle break showing the angled side walls.

FIG. 7 is a close-up view of the muzzle break showing the angled side sidewalls 98 and knife like point 100 formed when the curved sides 92 of the muzzle break 94 join with the angled sidewalls 98 converging at a knife like point 100. This point 100, formed at the front and rear of the plurality of elongated slots 96 helps parse gases from in front of and to the rear of projectiles passing through the muzzle break 94 on their trip down the gun barrel 86. Consequently the projectile exits the gun barrel with substantially decreased air turbulence affecting the trajectory of the projectile. This is due to the parsing of the trajectory altering gas currents before projectile's exit from the directional control of the barrel. While the best embodiment of the gun herein disclosed includes the muzzle break 94 with angled side walls 98, and curved sides 92, along with the other features herein disclosed, the muzzle break 94 with angled sidewalls 98 could also be used by itself or in combination with one or more of the enhancements disclosed herein to improved the handling characteristics of the gun herein disclosed or of conventional air powered guns lacking such improvements.

As can be seen from the description of the operation of the improvements to the gun herein disclosed, the regulator 30 and the trigger mechanism 70 and the muzzle break 94, all combine with the gun disclosed, to form the best embodiment of the device herein disclosed. However, the gun disclosed would also be an improvement over prior art, if any one of the group of improvements herein disclosed consisting of the regulator 30, trigger mechanism 70, and muzzle break 94, were used by itself, or in combination with another of the group of improvements so disclosed. Further, air guns currently sold would also benefit from the improved firing characteristics provided by one or a plurality of the group of improvements herein disclosed. Employment of the individual improvements, alone, or in combination with each other, on such conventional air guns, is therefor anticipated.

It should be understood that while the best embodiment of the device herein disclosed employs all of the group of individual improvements on the gun. Greatly improved performance and utility is also achieved, using one or more of the individual improvements with the air gun herein enclosed, or, with conventional air powered guns lacking the utility and improvements provided by one or more of the disclosed improvements. Further, while all of the fundamental characteristics and features of the Improved Gas Powered Gun and Assemblies Therefor have been shown and described, it should be understood that various substitutions, modifications, and variations may be made by those skilled in the art without departing from the spirit or scope of the invention. Consequently, all such modifications and variations are included within the scope of the invention as defined by the following claims.

What is claimed is:

1. An improved gas powered gun for firing projectiles using compressed gas comprising:

a gun body, said gun body having an input conduit for communication of a supply of compressed gas thereto, a barrel attached to said body, said barrel having an axial passageway therethrough for communication of said compressed gas for said firing of said projectiles, said axial passageway having a breach end and a muzzle end for discharge of projectiles therefrom;

a trigger mechanism mounted upon said body, said trigger mechanism capable of selective activation to allow communication of said compressed gas to said breach end of said axial passageway;

a gas pressure regulator means having a regulator body, said regulator body having an input cavity at a first end, said input cavity having a means of attachment of a pressurized air supply thereto, said regulator body having an exit chamber, said exit chamber attachable to a device requiring a compressed air supply, said exit chamber communicating through a central conduit with said input cavity in a sealed relationship;

said pressure regulator means having a laterally translatable adjustment piston communicating with said central conduit and having a piston biasing means for communicating a calculated bias to said adjustment piston toward a valve pin;

said valve pin having a head portion and having an engagement end distal to said head portion;

said valve pin laterally translatable through a seat aperture located in said central conduit to an infinite number of positions, from a first position wherein said engagement end is in a biased contact with a face on said adjustment piston, to a second position wherein said engagement end is substantially out of said biased contact with said adjustment piston;

a seal circumferentially mounted about said valve pin adjacent to said head portion on one side, and said seat aperture on an opposite side;

said seal terminating communication of compressed gas through said seat aperture when gas pressure imparted from said input cavity upon said head portion communicates biased contact to said engagement end sufficient to substantially overcome said calculated bias communicated to said adjustment piston; and said seal allowing compressed gas from said exit chamber and any device attached thereto, passively to exit said regulator, through said seat aperture, when said gas pressure in said input cavity is lowered below a predetermined level in said input cavity, thereby allowing gas pressure in said exit chamber and any attached device to vent through said input cavity;

whereby said seal terminates to flow of compressed gas to the exit chamber at a determined pressure level when said engagement end of said valve pin contacts and sufficiently translates said adjustment piston away from said valve pin, and said seal vents pressurized gas from said exit chamber, and any attached device when said supply of compressed gas is lowered below a predetermined level or removed from attachment with said inlet chamber.

2. The invention as defined in claim 1 further comprising:

said pressure regulator means having a means for transmitting sufficient heat from said regulator body to the interior of said pressure regulation means to avoid freezing thereof.

3. The invention as defined in claim 2 wherein said trigger mechanism comprises:

a trigger pin, said trigger pin dimensioned for lateral translation in a firing conduit, said trigger pin communicating with a trigger at a trigger end and having a sealing end distal to said trigger end;

a trigger slot in said trigger pin adjacent to said sealing end;

an accumulation chamber, said accumulation chamber selectively communicating with said axial passage of said barrel;

a connecting chamber, said connecting chamber communicating with said accumulation chamber through a connecting passage;

a firing conduit communicating pressurized gas from said input conduit to said connecting chamber;

a laterally translatable check valve located in said connecting passage, said check valve having a sealing end and having a valve conduit therethrough, said valve conduit providing for communication of pressurized gas from said connecting chamber to said accumulation chamber, said valve conduit providing substantial impedance of communication of pressurized gas from said accumulation chamber to said connecting chamber;

said check valve translatable to a sealed position sealing said axial passage from communication with said accumulation chamber, said check valve biased to said sealed position by gas pressure in said connecting chamber;

said check valve translatable to a discharge position providing communication between said accumulation chamber and said axial passage when gas pressure in said connecting chamber is rapidly lowered;

said trigger pin having a static position in said firing conduit and having a firing position in said firing conduit;

said firing conduit providing communication between said input conduit and said connecting chamber when said trigger pin is located in said static position;

said sealing end of said trigger pin providing a seal between said firing conduit and said input conduit when said trigger pin is in said firing position;

said trigger slot providing communication between said connecting chamber and a vent to the atmosphere when said trigger pin is translated to said firing position; and whereby said trigger when pulled by the user, moves said trigger pin to said firing position, thereby rapidly communicating gas pressure in said connecting chamber to said atmosphere by releasing said pressure through said vent, thereby causing said check valve to move from said sealed position to said discharge position, thereby causing pressurized gas in said accumulation chamber to pressurize said axial chamber to propel said projectile through said barrel.

4. The invention as defined in claim 2, further comprising, a muzzle break located at the distal end of said barrel, said muzzle break having a plurality of elongated slots communicating through the wall of said barrel with said axial passageway, said elongated slots having angled sidewalls.

5. The invention as defined in claim 4 wherein said elongated slots are oval in shape.

6. The invention as defined in claim 4 wherein said angled sidewalls have an angle between 30 degrees and 50 degrees.

7. The invention as defined in claim 2 wherein said means for transmitting heat comprises:

said engagement end of said valve pin dimensioned to yield a maximum surface area of contact with a cooperating cavity upon the face of said adjustment piston, said adjustment piston receptive to heat from said regulator body.

8. The invention as defined in claim 7 wherein said engagement end of said valve pin is hemispheric in shape and dimensioned to cooperatively engage said cooperating cavity upon the face of said adjustment piston, said cooperating cavity also having a hemispheric shape.

9. The invention as defined in claim one wherein said trigger mechanism comprises:

a trigger pin, said trigger pin dimensioned for lateral translation in a firing conduit, said trigger pin communicating with a trigger at a trigger end and having a sealing end distal to said trigger end;

a trigger slot in said trigger pin adjacent to said sealing end;

an accumulation chamber, said accumulation chamber selectively communicating with said axial passage of said barrel;

a connecting chamber, said connecting chamber communicating with said accumulation chamber through a connecting passage;

a firing conduit communicating pressurized gas from said input conduit to said connecting chamber;

a laterally translatable check valve located in said connecting passage, said check valve having a sealing end and having a valve conduit therethrough, said valve conduit providing for communication of pressurized gas from said connecting chamber to said accumulation chamber, said valve conduit providing substantial impedance of communication of pressurized gas from said accumulation chamber to said connecting chamber;

said check valve translatable to a sealed position sealing said axial passage from communication with said accumulation chamber, said check valve biased to said sealed position by gas pressure in said connecting chamber;

said check valve translatable to a discharge position providing communication between said accumulation chamber and said axial passage when gas pressure in said connecting chamber is rapidly lowered;

said trigger pin having a static position in said firing conduit and having a firing position in said firing conduit;

said firing conduit providing communication between said input conduit and said connecting chamber when said trigger pin is located in said static position;

said sealing end of said trigger pin providing a seal between said firing conduit and said input conduit when a said trigger pin is in said firing position;

said trigger slot providing communication between said connecting chamber and a vent to the atmosphere when said trigger pin is translated to said firing position; and whereby said trigger when pulled by the user, moves said trigger pin to said firing position, thereby rapidly communicating gas pressure in said connecting chamber to said atmosphere by releasing said pressure through said vent, thereby causing said check valve to move from said sealed position to said discharge position, thereby causing pressurized gas in said accumulation chamber to pressurize said axial chamber to propel said projectile through said barrel.

10. The invention as defined in claim 2, further comprising, a muzzle break located at the distal end of said barrel, said muzzle break having a plurality of elongated slots communicating through the wall of said barrel with said axial passageway, said elongated slots having angled sidewalls.

11. The invention as defined in claim 10 wherein said elongated slots are oval in shape.

12. The invention as defined in claim 10 wherein said angled sidewalls have an angle between 30 degrees and 50 degrees.

13. An improved gas pressure regulator comprising:

a regulator body, said regulator body having an input cavity at a first end, said input cavity having a means of attachment of a pressurized air supply thereto, said regulator body having an exit chamber, said exit chamber dimensioned to be attachable to a device requiring a compressed air supply, said exit chamber communicating through a central conduit with said input cavity in a sealed relationship;

a laterally translatable adjustment piston communicating with said central conduit and a piston biasing means for communicating a calculated bias to said adjustment piston toward a valve pin;

said valve pin having a head portion and having an engagement end distal to said head portion;

said valve pin laterally translatable through a seat aperture located in said central conduit to an infinite number of positions between a first position wherein said engagement end reaches a determined biased contact with a face on said adjustment piston, to a second position wherein said engagement end is out of said biased contact with said adjustment piston;

a seal circumferentially mounted about said valve pin adjacent to said head portion on one side, and said seat aperture on an opposite side;

said seal terminating communication of compressed gas through said seat aperture when gas pressure imparted from said input cavity upon said head portion communicates biased contact to said engagement end sufficient to substantially overcome said calculated bias communicated to said adjustment piston;

said seal allowing communication of compressed gas from said exit chamber and any device attached thereto, passively to exit said regulator, through said seat aperture, when said gas pressure in said input cavity is lowered below a predetermined level in said input cavity, thereby allowing gas pressure in said exit chamber and any attached device to vent through said input cavity; and whereby said seal terminates the flow of compressed gas to the exit chamber at a determined pressure level when said engagement end of said valve pin contacts and sufficiently translates said adjustment piston away from said valve pin, and said seal vents pressurized gas from said exit chamber, and any attached device, when said supply of compressed gas is lowered below a predetermined level or removed from attachment with said inlet chamber.

14. The improved gas pressure regulator as defined in claim 13 further comprising:

a means for transmitting sufficient heat from said regulator body to the interior of said gas pressure regulator to avoid freezing thereof.

15. The invention as defined in claim 14 wherein said means for transmitting heat comprises:

said engagement end of said valve pin dimensioned to yield a maximum surface area of contact with a cooperating cavity formed upon the face of said adjustment piston.

16. The invention as defined in claim 15 wherein said engagement end of said valve pin is hemispheric in shape and dimensioned to cooperatively engage said cooperating cavity upon the face of said adjustment piston, said cooperating cavity also having a hemispheric shape.

17. The invention as defined in claim 13 further comprising:

said seal being of a dimension to cover at least ⅓ the axial length of said valve pin.

18. The invention as defined in claim 13 wherein said seal is formed of a high resilience copolymer material of substantially a 95 shore.

19. An improved pressure differential trigger mechanism adapted to be coupled to a gas powered gun having a barrel with an axial passageway therethrough comprising:

a trigger pin, said trigger pin dimensioned for lateral translation in a firing conduit, said trigger pin communicating with a trigger at a trigger end and having a sealing end distal to said trigger end;

a trigger slot in said trigger rod adjacent to said sealing end;

an accumulation chamber, said accumulation chamber selectively communicating with said axial passageway of said barrel;

a connecting chamber said connecting chamber communicating with said accumulation chamber through a connecting passage;

a firing conduit communicating pressurized gas from an input conduit to said connecting chamber;

a laterally translatable check valve located in said connecting passage, said check valve having a sealing end and having a valve conduit therethrough, said valve conduit providing for communication of pressurized gas from said connecting chamber to said accumulation chamber, said valve conduit providing substantial impedance of communication of pressurized gas from said accumulation chamber to said connecting chamber;

said check valve translatable to a sealed position sealing said axial passageway from communication with said accumulation chamber, said check valve biased to said sealed position by gas pressure in said connecting chamber;

said check valve translatable to a discharge position providing communication between said accumulation chamber and said axial passage when gas pressure in said connecting chamber is rapidly lowered;

said trigger pin having a static position in said firing conduit and having a firing position in said firing conduit;

said firing conduit providing communication between said input conduit and said connecting chamber when said trigger pin is located in said static position;

said sealing end of said trigger pin providing a seal between said firing conduit and said input conduit when in said trigger pin is in said firing position;

said trigger slot providing communication between said connecting chamber and a vent to the atmosphere when said trigger pin is translated to said firing position; and whereby said trigger when pulled by the user, moves said trigger pin to said firing position, thereby rapidly communicating gas pressure in said connecting chamber to said atmosphere by releasing said pressure through said vent, thereby causing said check valve to move from said sealed position to said discharge position, thereby causing pressurized gas in said accumulation chamber to pressurize said axial passageway to propel a projectile through said barrel.

* * * * *